US009320950B2

(12) United States Patent
Matsunaga et al.

(10) Patent No.: US 9,320,950 B2
(45) Date of Patent: Apr. 26, 2016

(54) GOLF CLUB

(71) Applicant: DUNLOP SPORTS CO. LTD., Kobe-shi, Hyogo (JP)

(72) Inventors: Kiyofumi Matsunaga, Kobe (JP); Naruhiro Mizutani, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 111 days.

(21) Appl. No.: 14/329,713

(22) Filed: Jul. 11, 2014

(65) Prior Publication Data

US 2015/0031470 A1 Jan. 29, 2015

(30) Foreign Application Priority Data

Jul. 24, 2013 (JP) ..... 2013-153222

(51) Int. Cl.

| | |
|---|---|
| ***A63B 69/36*** | (2006.01) |
| ***A63B 53/06*** | (2015.01) |
| *A63B 53/04* | (2015.01) |
| *A63B 71/06* | (2006.01) |

(52) U.S. Cl.

CPC ..... *A63B 53/06* (2013.01); *A63B 53/0466* (2013.01); *A63B 2053/0433* (2013.01); *A63B 2071/0694* (2013.01)

(58) Field of Classification Search

CPC ..... A63B 53/06; A63B 2053/0433; A63B 53/0466; A63B 2071/0694; A63B 2053/023; A63B 2053/025; A63B 2053/026; A63B 2053/027

USPC ..... 473/328, 244–248

See application file for complete search history.

(56) References Cited

U.S. PATENT DOCUMENTS

| | | | | | |
|---|---|---|---|---|---|
| 2,175,598 | A * | 10/1939 | Fedak | A63B 53/06 | 473/245 |
| 4,174,108 | A * | 11/1979 | Reinholz | A63B 53/007 | 473/247 |
| 4,815,740 | A * | 3/1989 | Williams | A63B 53/065 | 403/97 |
| 5,807,186 | A * | 9/1998 | Chen | A63B 53/04 | 473/248 |
| 6,386,987 | B1 * | 5/2002 | Lejeune, Jr. | A63B 53/04 | 473/219 |
| 7,637,823 | B2 * | 12/2009 | Shimazaki | A63B 53/0466 | 473/332 |
| 7,824,280 | B2 * | 11/2010 | Yokota | A63B 53/0466 | 473/334 |
| 7,934,999 | B2 * | 5/2011 | Cackett | A63B 53/0466 | 473/242 |
| 8,210,961 | B2 * | 7/2012 | Finn | A63B 53/0466 | 473/244 |
| 9,108,090 | B2 * | 8/2015 | Stites | A63B 53/0466 | |
| 2011/0152000 | A1 | 6/2011 | Sargent et al. | | |
| 2012/0122601 | A1 | 5/2012 | Beach et al. | | |
| 2015/0031470 | A1 * | 1/2015 | Matsunaga | A63B 53/06 | 473/324 |

FOREIGN PATENT DOCUMENTS

JP 2004-267460 A 9/2004

* cited by examiner

*Primary Examiner* — Sebastiano Passaniti

(74) *Attorney, Agent, or Firm* — Birch, Stewart, Kolasch & Birch, LLP

(57) ABSTRACT

A golf club 2 includes a face angle adjusting mechanism 20 provided on a sole s4. The face angle adjusting mechanism 20 has a grounding member 22 which can be protruded from the sole s4, a storing part 24 storing the grounding member 22, and a coil spring 26 pressing the grounding member 22 so that the grounding member 22 is protruded from the storing part 24. The grounding member 22 is set so that a protruding amount of the grounding member 22 from the sole s4 is varied depending on its position of rotation angle about its axis in a state where the grounding member 22 is stored in the storing part 24. By changing a position of rotation angle of the grounding member 22, the protruding amount of the grounding member 22 is changed thereby to change a face angle.

13 Claims, 12 Drawing Sheets

GOLF CLUB

The present application claims priority on Patent Application No. 2013-153222 filed in JAPAN on Jul. 24, 2013, the entire contents of which are hereby incorporated by reference.

BACKGROUND OF THE INVENTION

1. Field of the Invention

The present invention relates to a golf club.

2. Description of the Related Art

A golf club including various adjusting functions is conventionally proposed. The adjusting function can improve the compatibility of a golf club and a golf player.

US 2011/0152000 and US 2012/0122601 disclose golf clubs including a head and a shaft detachably attached to the head. In these golf clubs, the axis of a shaft hole of a sleeve is inclined to a hosel axis. The inclination of a shaft axis enables the adjustment of a loft angle, a lie angle, and a face angle.

These U.S. gazettes disclose a golf club head including a head and a sole adjusting part attached to a bottom part of the head. The sole adjusting part is a mechanism for adjusting a face angle. The sole adjusting part is detachably attached to the bottom part of the head by a screw member. The sole adjusting part is attached to the bottom part of the head so that an edge face of the sole adjusting part can be protruded from a bottom face of the head. A protruding amount of an edge face of the sole adjusting part from the bottom face of the head can be gradually adjusted. The face angle is prescribed by the protruding amount.

The protruding amount of the edge face of the sole adjusting part is set depending on a predetermined position of rotation angle about its center axis. If the protruding amount is adjusted, the protruding amount of the sole adjusting part corresponding to a desired face angle is first selected. Then, the screw member is loosened or removed. The sole adjusting part is rotated about its center axis, and is made to stand still at a position of rotation angle corresponding to a desired protruding amount. Finally, the screw member is clamped by a torque equal to or greater than a predetermined value, thereby to fix the sole adjusting part to the head.

Japanese Patent Application Laid-Open No. 2004-267460 also discloses a hook angle adjusting member for adjusting a face angle (hook angle). The hook angle adjusting member has a plate shape. The hook angle adjusting member has a shape so that a plate thickness is gradually decreased (gradually increased) from one end to the other end. If a face angle of a golf club is changed, a hook angle adjusting member having a shape corresponding to a desired face angle is first selected. Then, the hook angle adjusting member is firmly fixed to a bottom face of a head by bonding, welding, and screwing or the like.

SUMMARY OF THE INVENTION

The sole adjusting part and the hook angle adjusting member require troublesome adjusting work. The present invention was made by taking the present circumstances into consideration. It is an object of the present invention to provide a golf club including a mechanism which can easily adjust a face angle.

A preferable golf club includes: a shaft; a head including a sole; and a face angle adjusting mechanism provided on the sole, wherein the face angle adjusting mechanism includes: a grounding member which can be protruded from the sole; a storing part storing the grounding member; and an elastic member pressing the grounding member so that the grounding member is protruded from the storing part;

the grounding member is set so that a protruding amount of the grounding member from the sole is varied depending on its position of rotation angle about its axis in a state where the grounding member is stored in the storing part; and the protruding amount of the grounding member is changed thereby to change a face angle, by changing a position of rotation angle of the grounding member against a pressing force of the elastic member.

Preferably, one of the grounding member and the storing part includes a plurality of parts to be locked;

the other of the grounding member and the storing part includes a locking part which can be engaged with each of the parts to be locked;

each of the plurality of parts to be locked corresponds to each of a plurality of different protruding positions of the grounding member;

the locking part and the part to be locked are locked by the pressing of the elastic member, thereby to position the grounding member at a protruding position corresponding to the part to be locked.

Preferably, the grounding member includes a columnar outer peripheral surface;

the storing part includes a columnar inner peripheral surface;

the part to be locked includes a part of a hollow formed in one of the outer peripheral surface of the grounding member and the inner peripheral surface of the storing part;

the locking part includes a locking projection formed on the other of the outer peripheral surface of the grounding member and the inner peripheral surface of the storing part; and the locking projection can be guided and locked to the hollow.

Preferably, the hollow includes the part to be locked and a guiding part;

the guiding part includes one of a bump and a groove extending in a direction including a circumferential component;

the part to be locked includes a notched part formed toward an axial direction from the guiding part;

the guiding part can guide circumferential movement of the locking projection in a state where the locking projection is pressed by the elastic member;

the grounding member is pressed by the elastic member thereby to elastically lock the locking projection in the axial direction to the part to be locked so as to bring about a state where the grounding member cannot be protruded in the axial direction, and cannot be rotated about its axis; and the grounding member is pressed against a pressing force of the elastic member thereby to separate the locking projection from the part to be locked so as to bring about a state where the grounding member can be rotated about its axis.

Preferably, the elastic member is a spring member interposed between a bottom part of the storing part and the grounding member.

DESCRIPTION OF THE PREFERRED EMBODIMENTS

The present invention will be described later in detail based on preferred embodiments with appropriate reference to the drawings.

Figure 1:
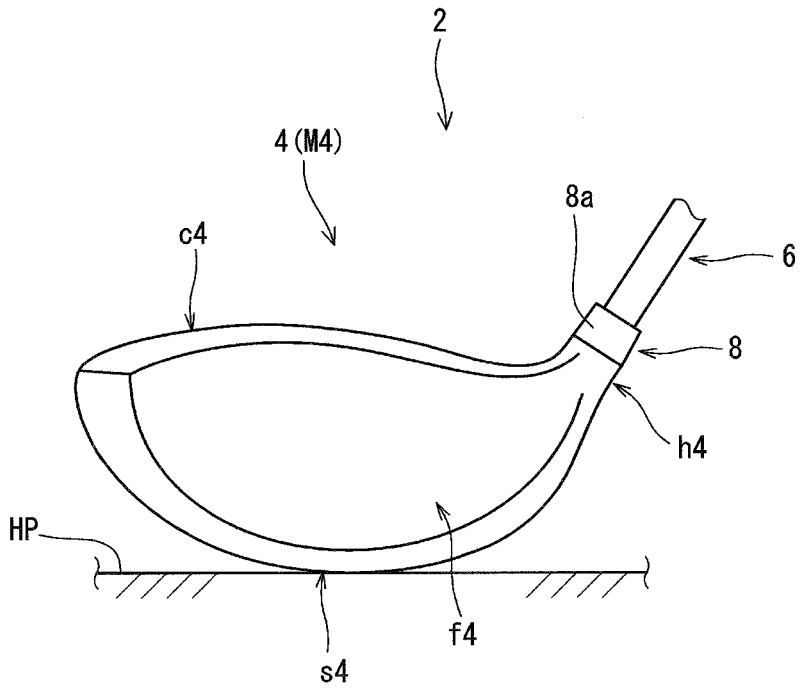
FIG. 1 is a front view showing a head of a golf club according to a first embodiment of the present invention.
Figure 2:
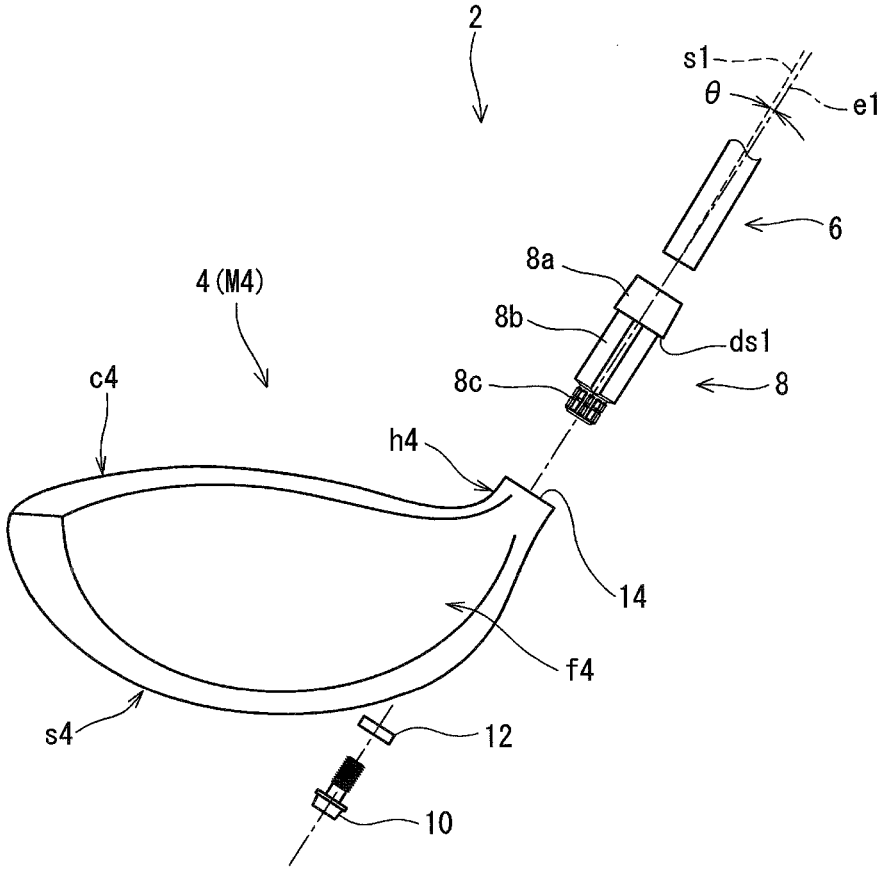
FIG. 2 is a front view of the golf club of FIG. 1 before being assembled.

FIG. 1 shows a golf club 2 of an embodiment of the present invention. FIG. 1 shows only a vicinity of a head of the golf club 2. FIG. 2 is an exploded view of the golf club 2.

The golf club 2 includes a head 4, a shaft 6, a sleeve 8, and a screw 10. The golf club 2 further includes a washer 12. The sleeve 8 is fixed to a tip part of the shaft 6. The fixation is achieved by adhesion using an adhesive agent. A grip which is not shown is attached to a back end part of the shaft 6.

The head 4 includes a body M4. As shown in FIGS. 1 and 2, the body M4 includes a crown c4, a sole s4, a face f4, and a hosel h4.

The head 4 of the embodiment is a wood type golf club. However, the type of the head 4 is not limited. Examples of the head 4 include a wood type head, a utility type head, a hybrid type head, an iron type head, and a putter head. Examples of the shaft 6 include a carbon shaft and a steel shaft.

The sleeve 8 is fixed to the head 4 by fastening the screw 10. Therefore, the shaft 6 is attached to the head 4. The sleeve 8 can be detached from the head 4 by loosening the screw 10. Therefore, the shaft 6 fixed to the sleeve 8 can also be detached from the head 4. Thus, the shaft 6 is detachably attached to the head 4.

Figure 3:
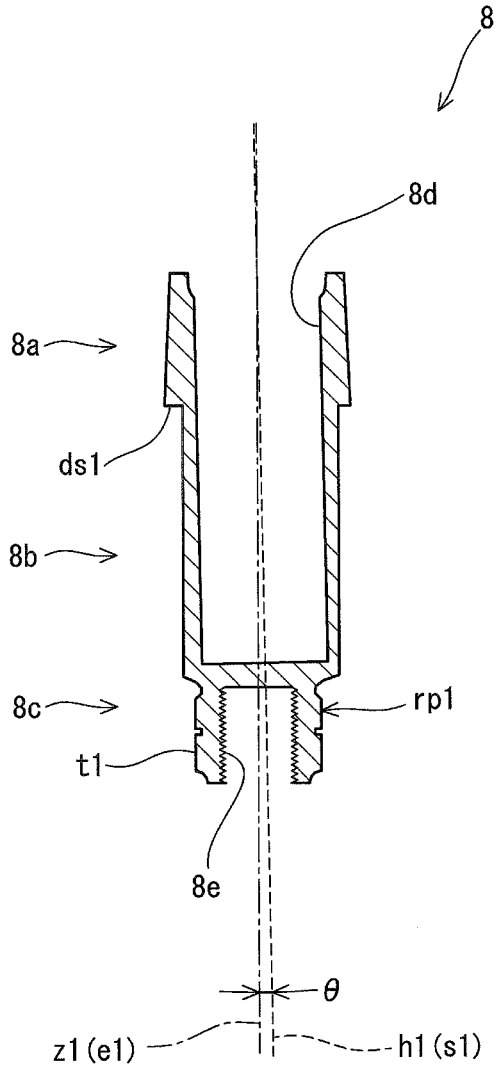
FIG. 3 is a longitudinal cross-sectional view of a sleeve in FIG. 2.
Figure 4:
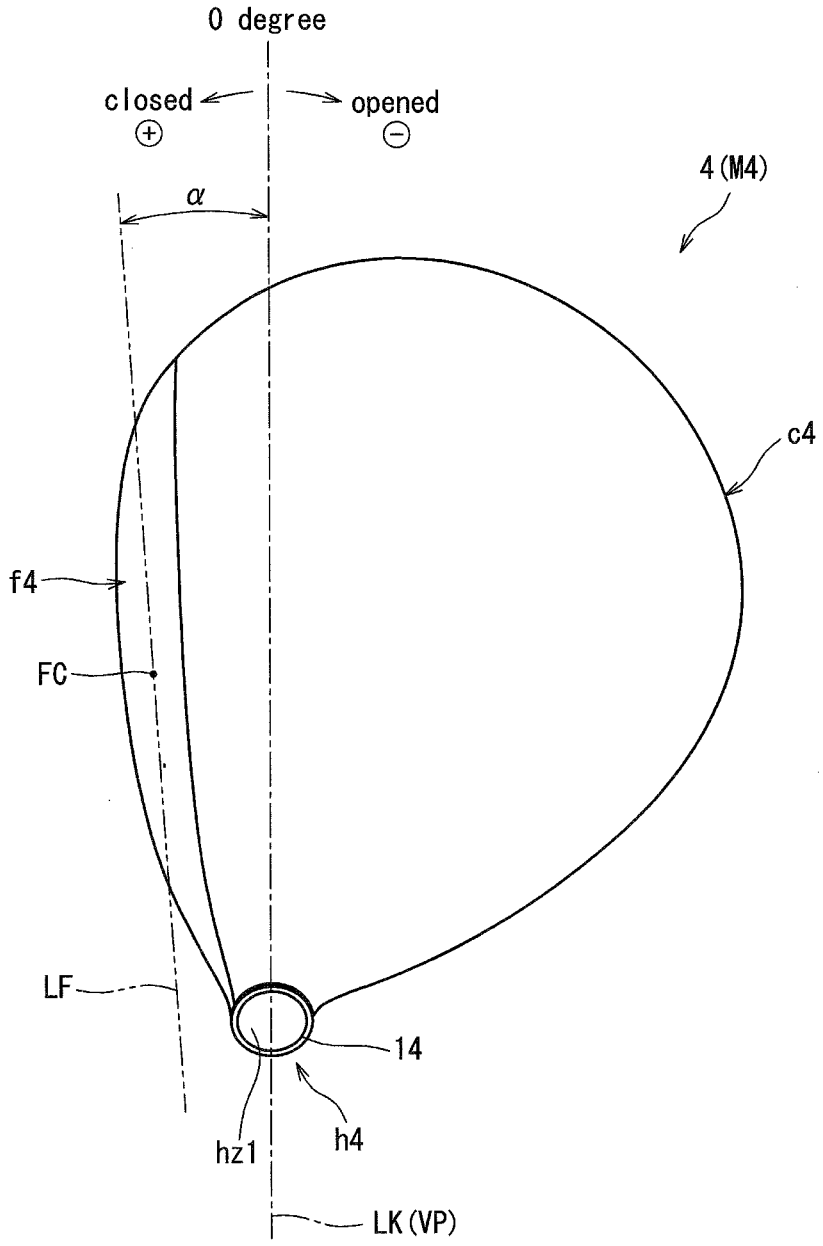
FIG. 4 is a plan view of the head of FIG. 1.
Figure 5:
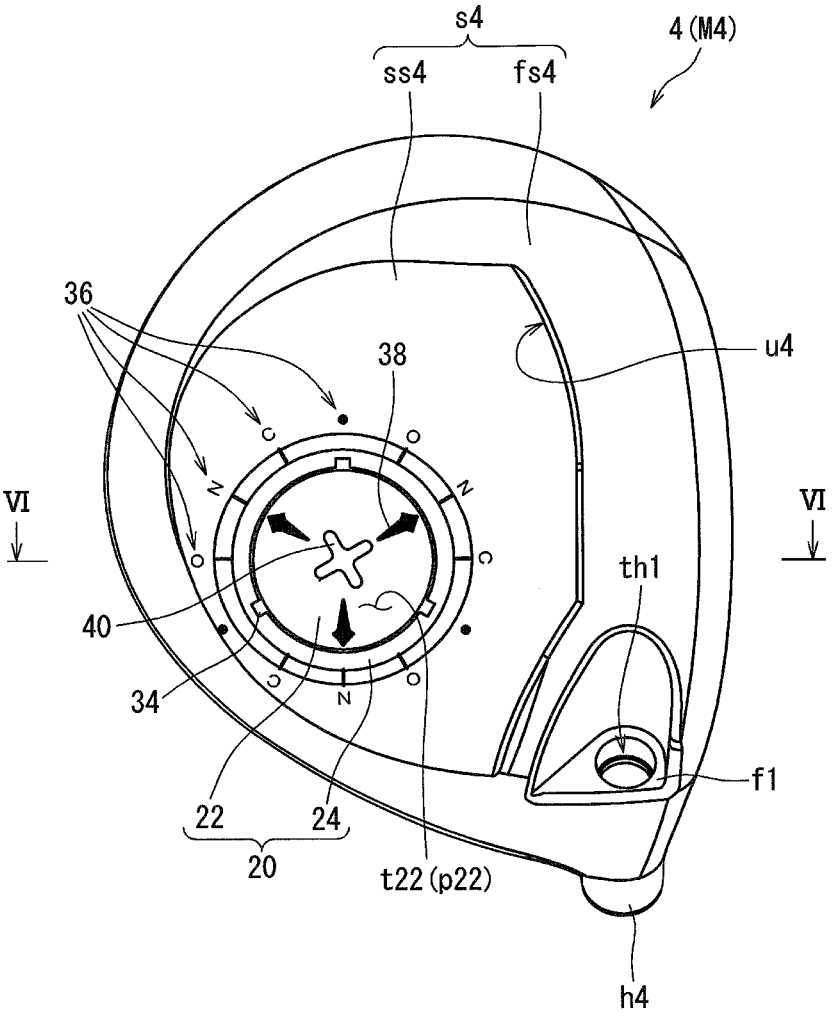
FIG. 5 is a bottom view of the head to which a grounding member is attached.
Figure 6:
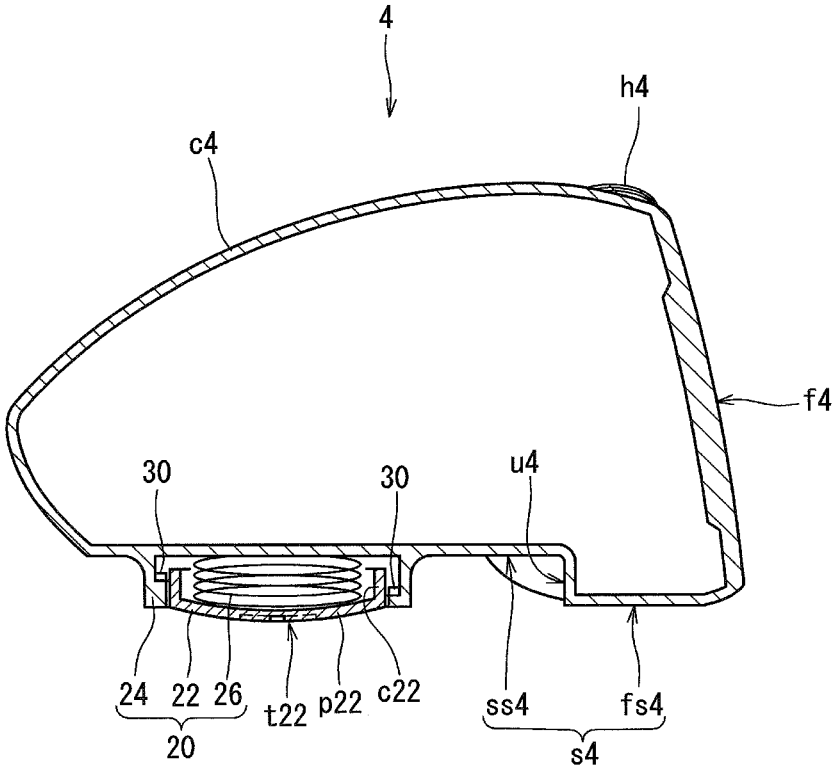
FIG. 6 is a cross-sectional view taken along line VI-VI of FIG. 5.

FIG. 3 is a cross-sectional view of the sleeve 8. FIG. 4 is a plan view of the head 4. FIG. 5 is a bottom view of the head 4. FIG. 6 is a cross-sectional view taken along line VI-VI of FIG. 5. As shown in FIG. 6, the head 4 is hollow.

The hosel h4 has a hosel hole hz1 (see FIG. 4) into which the sleeve 8 is inserted, and a through hole th1 (see FIG. 5) into which the screw 10 is inserted. The through hole th1 passes through a bottom part of the hosel hole hz1.

The sleeve 8 includes an upper part 8*a*, an intermediate part 8*b*, and a lower part 8*c*. A bump surface ds1 is formed on a boundary between the upper part 8*a* and the intermediate part 8*b*. The sleeve 8 has a shaft hole 8*d* and a screw hole 8*e*. The shaft hole 8*d* passes through the upper part 8*a*, and leads to the intermediate part 8*b*. The shaft hole 8*d* is opened to an upper side (a shaft side). The screw hole 8*e* is formed in the lower part 8*c*. The screw hole 8*e* is opened to a lower side (a sole side).

As shown in FIG. 1, in a usable assembled state, the upper part 8*a* is exposed to the outside. In the assembled state, the bump surface ds1 abuts on a hosel end face 14 of the head 4. As shown in FIG. 1, an outer diameter of a lower end of the upper part 8*a* is substantially equal to an outer diameter of the hosel end face 14. In the assembled state, the upper part 8*a* exhibits an appearance like a ferrule. In the assembled state, the intermediate part 8*b* and the lower part 8*c* are inserted into the hosel hole hz1. An outer surface of the intermediate part 8*b* includes a circumferential surface. The circumferential surface is brought into surface contact with an inner surface of the hosel hole hz1. The hosel hole hz1 supports the intermediate part 8*b* in the surface contact.

The lower part 8*c* of the sleeve 8 includes a rotation-preventing part rp1. A sectional shape of the rotation-preventing part rp1 is a non-circular form. In the embodiment, the rotation-preventing part rp1 includes a plurality of projections t1. The projections t1 are outwardly protruded in the radial direction. The plurality of projections t1 are disposed at equal intervals in a circumferential direction.

The rotation-preventing part rp1 is engaged with a rotation-preventing part (not shown) provided on the head 4. Although not shown in the drawings, a plurality of recesses are formed in the rotation-preventing part of the head 4. The plurality of recesses are disposed at equal intervals in the circumferential direction. A shape of the recess corresponds to a shape of the projection t1 described above. That is, the recess and the projection t1 have a complementary shape to each other. Each of the projections t1 is engaged with the corresponding recess. The relative rotation of the head 4 and the sleeve 8 is prevented by the engagement.

As shown in FIG. 3, a center axis line h1 of the shaft hole 8*d* is inclined to a center axis line z1 of the sleeve 8. An angle θ shown in FIG. 3 is an angle between the axis line h1 and the axis line z1. An axis line s1 of the shaft 6 is inclined to an axis line e1 of the hosel hole due to the inclination of the center axis line z1. The inclination angle is also θ.

The sleeve 8 can be fixed to the head 4 at a plurality of positions of rotation angle about its center axis (its axis). The direction of the axis line s1 of the shaft 6 to the head 4 can be changed depending on the plurality of positions of rotation angle and the angle θ. A face angle, a lie angle, and a real loft angle can be changed by the position of rotation angle of the sleeve 8. The face angle, the lie angle, and the real loft angle can be adjusted by selecting the position of rotation angle of the sleeve 8. In the adjustment, the face angle, the lie angle, and the real loft angle are interlocked with each other.

The prevention of coming off of the sleeve 8 is achieved by screw connection of the sleeve 8 and the screw 10. In the assembled state, the screw 10 is inserted into the through hole th1, and connected to the screw hole 8*e* of the sleeve 8 in a screwing manner. In the assembled state, a head part of the screw 10 cannot pass through the through hole th1. The head part of the screw 10 abuts on a lower surface f1 (see FIG. 5) of the head 4 with the washer 12 interposed between the head part and the lower surface f1. The screw 10 produces an axial force in the abutment. The bump surface ds1 is pressed against the hosel end face 14 by the axial force. The movement of the sleeve 8 upward in an axial direction is restricted by the axial force. The fixation of the sleeve 8 in the axial direction is maintained by the screw 10.

As shown in FIGS. 5 and 6, the head 4 includes a face angle adjusting mechanism 20. The face angle adjusting mechanism 20 is disposed on the sole s4. The face angle adjusting mechanism 20 includes a grounding member 22, a storing part 24, and an elastic member 26 which can apply an elastic force. In the embodiment, a coil spring 26 is employed as the elastic member. The grounding member 22 and the coil spring 26 are stored in the storing part 24 in a state where the grounding member 22 and the coil spring 26 can be taken out. In the embodiment, the coil spring 26 is disposed between the grounding member 22 and a bottom face of the storing part 24.

Figure 7C:
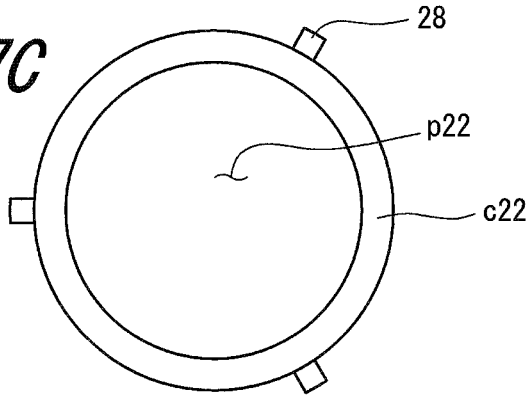
FIG. 7C is a bottom view of the grounding member.
Figure 7A:
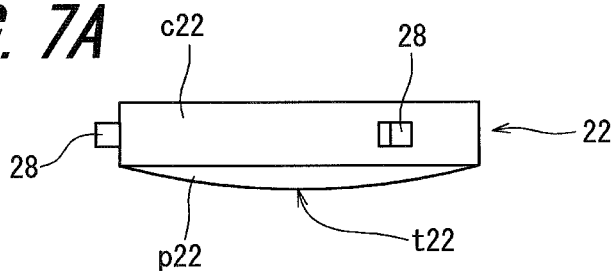
FIG. 7A is a front view of the grounding member.
Figure 7B:
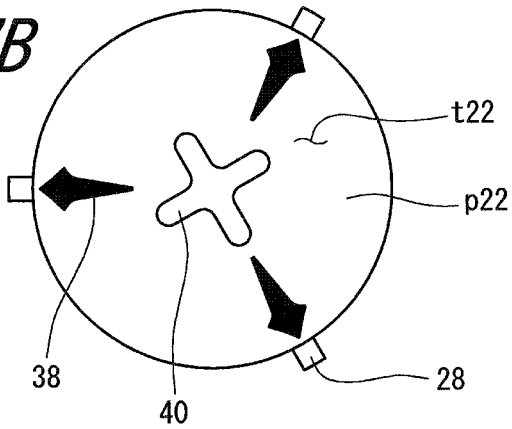
FIG. 7B is a plan view of the grounding member.

The grounding member 22 is shown in FIGS. 7A, 7B and 7C. FIG. 7A is a front view of the grounding member 22. FIG. 7B is a plan view (outer surface view) of the grounding member 22. FIG. 7C is a bottom view (inner surface view) of the grounding member 22. The grounding member 22 includes a disc part p22 and a cylindrical part c22 formed around the disc part p22. An outer surface t22 of the disc part p22 has an outwardly protruded spherical shape. However, the shape of the outer surface t22 is not limited to the spherical shape. The outer surface t22 is also referred to as a grounding surface t22. If the golf club 2 is placed on a level surface HP at a specified lie angle, the grounding surface t22 and a front part (face side) of the sole s4 can be grounded on the level surface HP. A locking projection 28 as a locking part is provided so as to be outwardly protruded in the radial direction on the outer peripheral surface of the cylindrical part c22. In the embodiment, the three locking projections 28 are formed at intervals of 120 degrees. However, the number of the locking projections 28 is not limited to 3.

As shown in FIG. 7B, arrows 38 are applied to positions corresponding to the three locking projections 28 on the grounding surface t22 of the disc part p22 of the grounding member 22. The arrows 38 are applied at intervals of 120 degrees along the peripheral border of the grounding surface t22. The arrows 38 face outwardly in the radial direction. A cross groove 40 with which a rotary tool such as a driver can be engaged is formed in the central part of the grounding surface t22 of the disc part p22. The groove is not limited to the cross groove 40, and may be a groove coinciding with a tip shape of the rotary tool, or the like.

Figure 8:
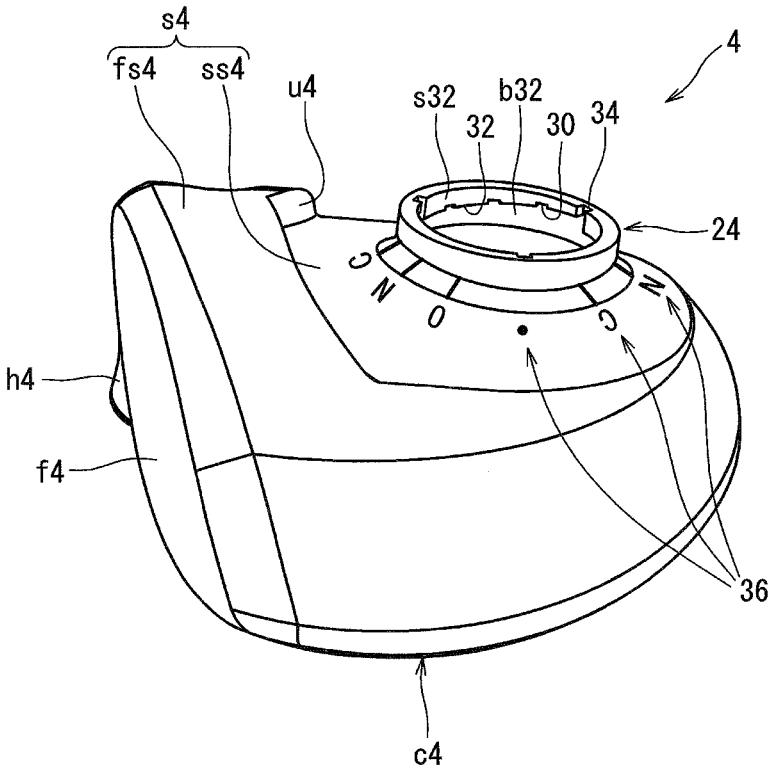
FIG. 8 is a perspective view of a head body to which the grounding member is not attached.
Figure 10:
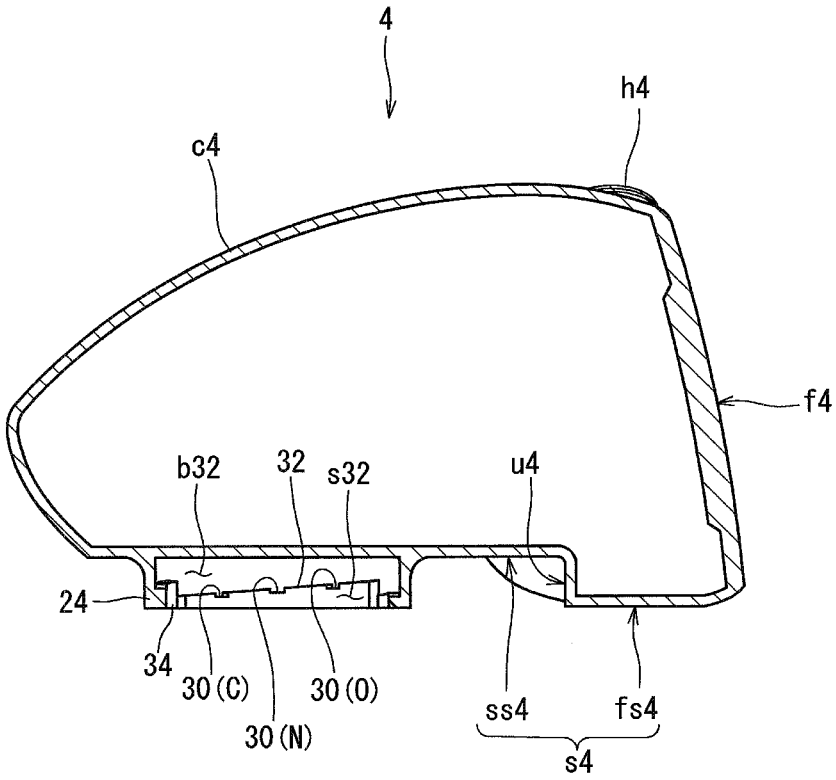
FIG. 10 is a cross-sectional view taken along line X-X of FIG. 9A.

As shown in FIGS. 6, 8, and 10, a bump u4 is formed in the sole s4 of the head 4. In other words, a second surface ss4 is formed in the surface of the sole s4. The second surface ss4 is formed by denting a back side portion of the sole s4 to a crown side. A surface other than the second surface of the sole s4 is referred to as a first surface fs4. The storing part 24 is provided on the second surface ss4. The position of the storing part 24 on the second surface ss4 can be freely set. In light of a sole shape and face angle adjustment, the position of the storing part 24 can be freely set. Therefore, the free setting can respond to a complicated sole shape, and can realize desired face angle adjustment. The height of the upper end of the storing part 24 from the second surface ss4 is nearly the same as the bump u4. If the golf club 2 is placed on the level surface HP (FIGS. 1, 11A, 11B and 11C) at a specified lie angle, the opening end of the storing part 24 and the front part (first surface fs4) of the sole s4 can be grounded on the level surface HP.

As shown in FIGS. 6 to 10, the storing part 24 has a cylindrical shape. The storing part 24 is opened to the outside of the sole s4. The storing part 24 has a columnar internal space. The inner diameter of the storing part 24 is slightly greater than the outer diameter of the cylindrical part c22 of the grounding member 22. The grounding member 22 can be coaxially stored in the storing part 24. The disc part p22 of the grounding member 22 can be protruded from the opening end of the storing part 24. The grounding member 22 can be rotated about its center axis (its axis) in the storing part 24. A part to be locked 30 to which the locking projection 28 of the grounding member 22 can be locked is formed in the inner peripheral surface of the storing part 24.

As shown in FIGS. 8 to 10, the part to be locked 30 is formed in a bump 32 formed in the inner peripheral surface of the storing part 24. The bump 32 is constituted as a boundary between an opening side small diameter part s32 and a depth side large diameter part b32 in the inner peripheral surface of the storing part 24. The large diameter part b32 can be referred to as a hollow for the small diameter part s32. The bump 32 is sectioned into three at intervals of 120 degrees along the circumferential direction. The circumferential lengths of the sections of the bump 32 are the same. Each section of the bump 32 is inclined to an axial direction from the circumferential direction of the storing part 24. The direction in which the bump 32 extends contains a circumferential component. The sections of the bump 32 are formed at the same position in the axial direction. The inclination angles of the sections of the bump 32 to the axial direction from the circumferential direction are the same.

The part to be locked 30 includes a notched part notched to the small diameter part s32 side (opening side) in the axial direction from the bump 32. The radial depth of the part to be locked 30 has the same size as the bump 32. The radial bottom face of the part to be locked 30 is flush with the inner peripheral surface of the large diameter part b32. The part to be locked 30 can also be referred to as a hollow for the small diameter part s32. In the embodiment, the locking projection 28 has a rectangular cylindrical shape. However, the shape of the locking projection 28 is not limited to the rectangular columnar shape, and may be a columnar shape or the like. The part to be locked 30 has a rectangular cross section. The part to be locked 30 has an approximately complementary shape to the locking projection 28.

The locking projection 28 is locked to the part to be locked 30 toward the axial opening side of the storing part 24 by the pressing force of the coil spring 26. Furthermore, the locking projection 28 is locked also in the circumferential direction. Thereby, the unintended rotation of the grounding member 22 about its axis is prevented. The three parts to be locked 30 are formed at regular intervals in the circumferential direction in each of the three sections of the bump 32 described above. In the embodiment, the parts to be locked 30 are formed at intervals of 30 degrees. If the grounding member 22 is rotated, the bump 32 serves as a guiding part guiding the circumferential displacement of the locking projection 28.

Figure 9A:
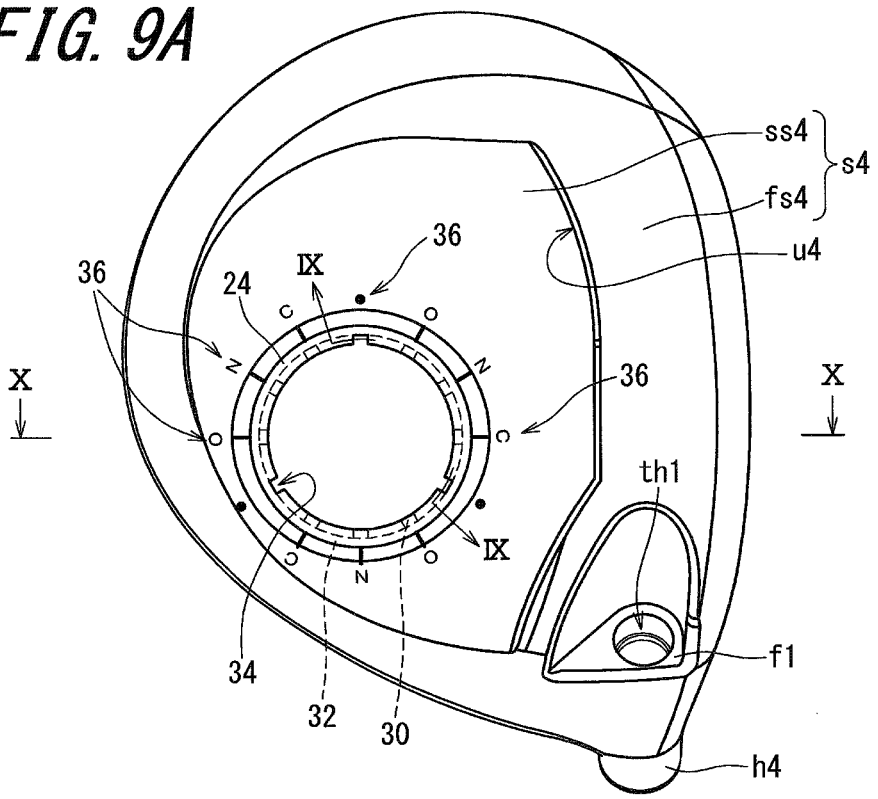
FIG. 9A is a bottom view of the head body.
Figure 9B:
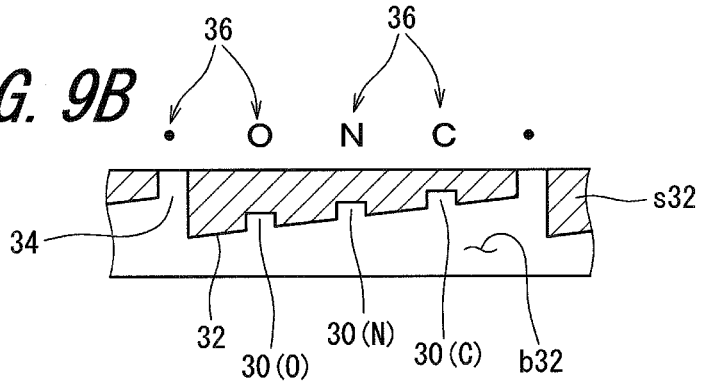
FIG. 9B is a cross-sectional view taken along line IX-IX of FIG. 9A.

FIG. 9B is a cross-sectional view taken along line IX-IX of FIG. 9A. FIG. 9B is a cross-sectional view shown by developing an inner peripheral side portion of the storing part 24 in FIG. 9A. As is obvious from FIG. 9B, all the parts to be locked 30 have the same shape. That is, the circumferential widths and the axial depth sizes of all the parts to be locked 30 are the same. In FIG. 9B, signs of O, N, and C applied to the three parts to be locked 30 respectively mean opened, neutral, and closed as described later. The difference in size at an axial position between the part to be locked 30 of O and the part to be locked 30 of N is the same as the difference in size at an axial position between the part to be locked 30 of N and the part to be locked 30 of C. In other words, the depth end positions of the three parts to be locked 30 in the axial direction correspond to the inclination of the bump 32.

The bump 32 is inclined to the axial direction from the circumferential direction. However, the bump 32 may be a bump extending only in the circumferential direction without being inclined in the axial direction. In this case, it is necessary to make the depth end positions of the three parts to be locked 30 in the axial direction different from each other as in FIG. 9B.

In the three sections of the bump 32, the shapes and the disposals of the three parts to be locked 30 of O, N, and C are the same. In the bump 32 having the three sections, the part to be locked 30 of C is positioned on the most opening side of the storing part 24 in the axial direction. The part to be locked 30 of O is positioned on the most depth side of the storing part 24 in the axial direction. The part to be locked 30 of N is positioned at a central position between the part to be locked 30 of C and the part to be locked 30 of O in the axial direction.

The three parts to be locked 30 of C are positioned at intervals of 120 degrees in the circumferential direction. The three parts to be locked 30 of N are also positioned at intervals of 120 degrees in the circumferential direction. The three parts to be locked 30 of O are also positioned at intervals of 120 degrees in the circumferential direction. Therefore, the three locking projections 28 described above are simultaneously locked to the three parts to be locked 30 of C. The three locking projections 28 are simultaneously locked to the three parts to be locked 30 of N. The three locking projections 28 are simultaneously locked to the three parts to be locked 30 of O. If the locking projection 28 is locked to the part to be locked 30 of C, the grounding member 22 is positioned on the outermost side in the axial direction in the storing part 24. If the locking projection 28 is locked to the part to be locked 30 of O, the grounding member 22 is positioned on the innermost side in the axial direction in the storing part 24.

As shown in FIG. 9B, an attaching/detaching groove 34 extending in the axial direction is formed in each of the boundaries of three sections of the bump 32. The attaching/detaching groove 34 has a rectangular cross section. The circumferential angular interval between the attaching/detaching groove 34 and the adjacent part to be locked 30 is 30 degrees. The attaching/detaching groove 34 is outwardly communicated with the opening side of the storing part 24 from the large diameter part b32. Therefore, the locking projection 28 passes through the attaching/detaching groove 34, and thereby the locking projection 28 can enter into the storing part 24, and can get out of the storing part 24. The radial depth of the attaching/detaching groove 34 is the same as the depth of the bump 32. That is, the bottom face of the attaching/detaching groove 34 is flush with the inner peripheral surface of the large diameter part b32. However, the constitution of the attaching/detaching groove 34 is not limited, as long as the locking projection 28 can be smoothly movable between the large diameter part b32 and the attaching/detaching groove 34.

A part of the coil spring 26 is kept in the internal space of the cylindrical part c22 of the grounding member 22 in the storing part 24. If the locking projection 28 is locked to the bump 32 or the part to be locked 30, the coil spring 26 is in a compressed state between the bottom face of the storing part 24 and the grounding member 22. The coil spring 26 biases the grounding member 22 in a direction in which the grounding member 22 is extruded from the opening of the storing part 24. The shape of the grounding member 22 is not limited to the cylindrical shape. The grounding member 22 may have a columnar shape.

The grounding member 22 can be rotated about its axis in the storing part 24 by an external force. If the locking projection 28 is locked to any of the parts to be locked 30, the grounding member 22 is pressed in the axial direction of the storing part 24 against the restoring force of the coil spring 26 by the external force. Thereby, the locking of the locking projection 28 to the part to be locked 30 is released. In this state, the grounding member 22 is rotated about its axis to the circumferential position corresponding to the other part to be locked 30. Here, if the pressing external force to the grounding member 22 is released, the locking projection 28 is locked to the other part to be locked 30 by the restoring force of the coil spring 26. If the locking projection 28 is positioned at the circumferential position corresponding to the attaching/detaching groove 34, and the pressing external force to the grounding member 22 is released, the grounding member 22 can be separated from the storing part 24. A leaf spring or the like may be used in place of the coil spring.

As described above, it is not necessary to remove the grounding member 22 from the storing part 24 in order to set the grounding member 22 at the adjustment positions of C, N, and O, and work for loosening a screw or the like is not also required. As described above, the depth sizes of all the parts to be locked 30 in the axial direction from the bump 32 are the same. Therefore, even if the locking projection 28 is locked to any of the three parts to be locked 30, the grounding member 22 may be pressed into the storing part 24 by the same distance in order to release the locking. The face angle adjusting mechanism 20 facilitates the adjusting work of the face angle.

As shown in FIGS. 5, 9A, 9B and 9C, marks 36 showing the adjustment position of the face angle are put around the storing part 24 on the second surface ss4 of the sole s4. The marks 36 and the positions of the marks 36 correspond to the positions of the three parts to be locked 30 of C, N, and O described above, and the position of the attaching/detaching groove 34. The mark of C is applied to the position corresponding to the part to be locked 30 of C; the mark of N is applied to the position corresponding to the part to be locked 30 of N; the mark of O is applied to the position corresponding to the part to be locked 30 of O; and the mark of dot is applied to the position corresponding to the attaching/detaching groove 34. All the marks are put at intervals of 30 degrees in the circumferential direction. The kind of the marks 36 is not limited.

Meanwhile, as described above, the arrows 38 are applied to positions corresponding to the three locking projections 28 on the grounding surface t22 of the grounding member 22, and the cross groove 40 is formed in the central part. The arrows 38 are made to correspond to any of the marks 36 of O, N, C, and dot by rotating the grounding member 22 in a state where the grounding member 22 is attached to the storing part 24, and thereby the locking projections 28 can be positioned to the three parts to be locked 30 of O, N, C and the attaching/detaching grooves 34.

Figure 11A:
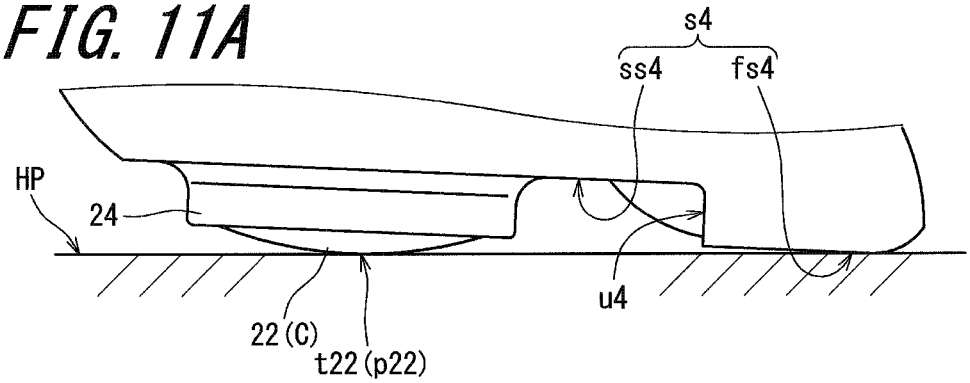
FIG. 11A is a side view of a sole for describing a method for adjusting a face angle.
Figure 11B:
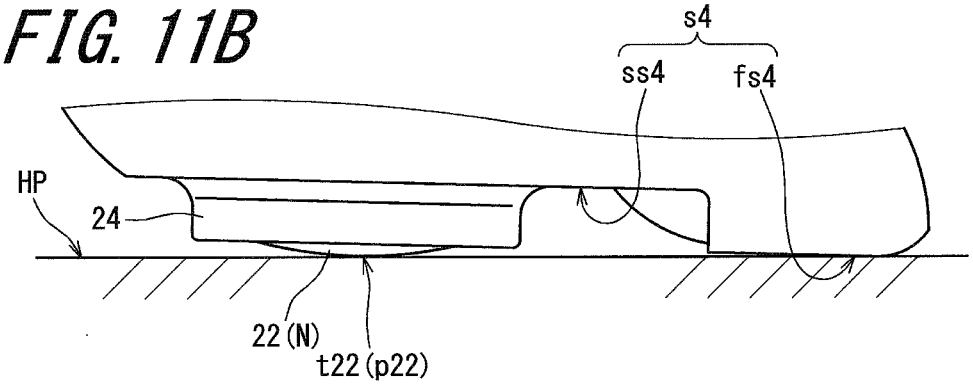
FIG. 11B is a side view of a sole for describing the method for adjusting a face angle.
Figure 11C:
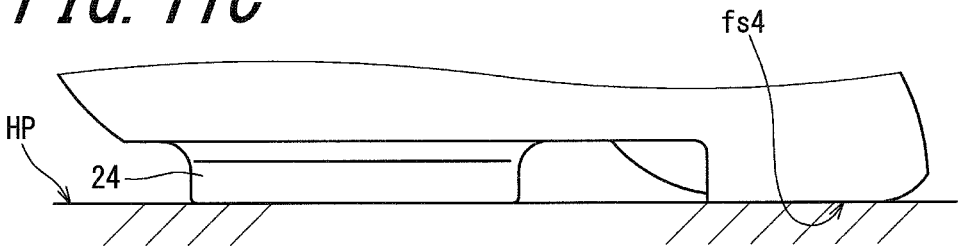
FIG. 11C is a side view of a sole for describing the method for adjusting a face angle.

FIGS. 11A, 11B and 11C show the protruding position of the grounding member 22 from the storing part 24 when the locking projections 28 are locked to the parts to be locked 30 of O, N, and C. Each of FIGS. 11A, 11B and 11C is a side view of the sole s4 for describing a method for adjusting the face angle. In a face angle measurement state to be described later, the grounding places of the head 4 are the first surface fs4 of the sole s4 and the grounding member 22. The grounding member 22 is displaced in the axial direction, and thereby the face angle can be changed. In the embodiment, as the grounding member 22 is protruded from the second surface ss4 of the sole s4, the face angle is closed.

FIG. 11A shows the sole s4 when the locking projection 28 is locked to the part to be locked 30 of C. FIG. 11A shows the posture of the head 4 at the C (closed) adjustment position, as it were. FIG. 11A shows the protruding position of the grounding member 22 to the storing part 24 in this state. The disc part p22 of the grounding member 22 is outwardly protruded in the axial direction from the opening of the storing part 24. The grounding surface t22 and the front part of the first surface fs4 of the sole s4 can be grounded on the level surface HP.

FIG. 11B shows the sole s4 when the locking projection 28 is locked to the part to be locked 30 of N. FIG. 11B shows the posture of the head 4 at the N (neutral) adjustment position as it were. FIG. 11B shows the protruding position of the grounding member 22 to the storing part 24 in this state. The disc part p22 of the grounding member 22 is outwardly protruded in the axial direction from the opening of the storing part 24. The protruding amount is smaller than the protruding amount of the grounding member 22 in FIG. 11A. For example, the protruding amount is about ½ of the protruding amount of the grounding member 22 in FIG. 11A. The grounding surface t22 and the first surface fs4 of the sole s4 can be grounded on the level surface HP.

FIG. 11C shows the sole s4 when the locking projection 28 is locked to the part to be locked 30 of O. FIG. 11C shows the posture of the head 4 at the O (open) adjustment position as it were. FIG. 11C shows the position of the grounding member 22 to the storing part 24 in this state. The grounding member 22 is not protruded from the opening of the storing part 24. The opening end of the storing part 24 and the first surface fs4 of the sole s4 can be grounded on the level surface HP.

In the embodiment, the face angle is adjusted at three stages. Since the protruding amount of the grounding member in FIG. 11A is increased as compared with FIG. 11B, the face angle is closed. If the sole s4 is grounded to address the golf club, the face of the head of FIG. 11A is apt to turn to the left in FIG. 4 as compared with the face of the head of FIG. 11B. Since the protruding amount of the grounding member in FIG. 11C is decreased as compared with FIG. 11B, the face angle is opened. If the sole s4 is grounded to address the golf club, the face of the head of FIG. 11C is apt to turn to the right in FIG. 4 as compared with the face of the head of FIG. 11B.

Although the grounding member 22 is not protruded from the opening of the storing part 24 in FIG. 11C showing the O (opened) adjustment position, the constitution is not limited. The grounding member 22 may be protruded from the opening of the storing part 24 at the adjustment positions of C, N, and O according to the height of the storing part 24, or the like.

The adjustable range of the face angle is preferably large. However, the excessively closed face angle and the excessively opened face angle are unnecessary. In light of them, the lower limit of the adjustable range of the face angle is preferably equal to or greater than 2 degrees, and more preferably equal to or greater than 3 degrees. The upper limit of the adjustable range is preferably equal to or less than 10 degrees, more preferably equal to or less than 8 degrees, and still more preferably equal to or less than 6 degrees. For example, if the maximum value of the face angle is +1 degree, and the minimum value of the face angle is −1 degree, the adjustable range of the face angle is 2 degrees.

[Material of Grounding Member 22]

The material of the grounding member 22 is not limited. Preferable examples of the material include a metal, a resin, and a fiber-reinforced resin. In respect of a strength and durability, the metal is preferable. Examples of the metal include a titanium alloy, stainless steel, an aluminum alloy, a magnesium alloy, a tungsten-nickel alloy, and a tungsten alloy. Examples of the resin include an engineering plastic and a super-engineering plastic. Examples of the fiber-reinforced resin include CFRP (carbon fiber-reinforced plastic). If the movement of the center of gravity of the head is suppressed, a material having a small specific gravity is preferable. In this respect, the fiber-reinforced resin, the titanium alloy, the aluminum alloy, and the magnesium alloy are preferable, and the aluminum alloy is more preferable.

A method for manufacturing the grounding member 22 is not limited. Examples of the method include forging, sintering, casting, die-casting, NC processing, press forming, and injection molding. A method for manufacturing the non-grounding member X2 is not limited. Examples of the method include forging, sintering, casting, die-casting, NC processing, press forming, and injection molding.

[Method for Measuring Face Angle]

In the measurement of the face angle, the golf club 2 is placed on the level surface HP at a specified lie angle. The axis line s1 of the shaft is disposed in a plane VP perpendicular to the level surface HP. The shaft 6 can move in the direction of the axis line s1 in a state where the lie angle is held, and the shaft 6 is rotatably supported around the axis line s1. The sole s4 is grounded on the level surface HP so that the head 4 is most stable while the support of the shaft 6 is maintained. The state where the head 4 is most stable is also referred to as a face angle measurement state. In the face angle measurement state, the face angle is measured. In FIG. 4, a straight line LF shown by a chain double-dashed line is a tangent line brought into contact with the face f4 in a center point FC of the face f4. The tangent line LF is parallel to the level surface HP. The face angle is measured based on the tangent line LF. A line of intersection between the level surface HP and the plane VP is defined as LK. The line of intersection LK can be said to be a projection line to the level surface HP of the axis line s1 of the shaft. At this time, an angle $\alpha$ between the line of intersection LK and the tangent line LF in the plan view is the face angle. The angle $\alpha$ can be measured by a measuring apparatus shown in FIG. 14 in Japanese Patent Application Laid-Open No. 2004-267460. In Japanese Patent Application Laid-Open No. 2004-267460, the face angle in the present application is referred to as a hook angle.

The center point FC of the face f3 is defined as the center of a figure of the face f3 in the plan view.

In the case of a driver (No. 1 wood), the specified lie angle is usually 56 degrees or greater and 60 degrees or less. The real loft angle of the driver is usually 8 degrees or greater and 13 degrees or less. The club length of the driver is usually 43 inches or greater and 48 inches or less. The club length is measured based on the golf rule of "1c. Length" in "1. Clubs" of "Appendix II. Design of Clubs" specified by R&A (Royal and Ancient Golf club of Saint Andrews).

In the present application, the direction of the line of intersection LK is defined as a toe-heel direction. The direction perpendicular to the toe-heel direction and parallel to the level surface HP is defined as a face-back direction.

In the present application, a plus or minus sign is applied to the value of the face angle $\alpha$ (see FIG. 4). If the face f4 is closed to the line of intersection LK, the face angle $\alpha$ is described as a plus value. If the face f4 is opened to the line of intersection LK, the face angle $\alpha$ is described as a minus value. In the state shown in FIG. 4, the face f4 is closed, and the face angle $\alpha$ is a plus value.

In the embodiment described above, the locking projection 28 is provided on the grounding member 22, and the part to be locked 30 is provided in the storing part 24. However, the constitution is not limited. A projection to be locked may be provided on the grounding member, and the locking part may be provided in the storing part.

Figure 12:
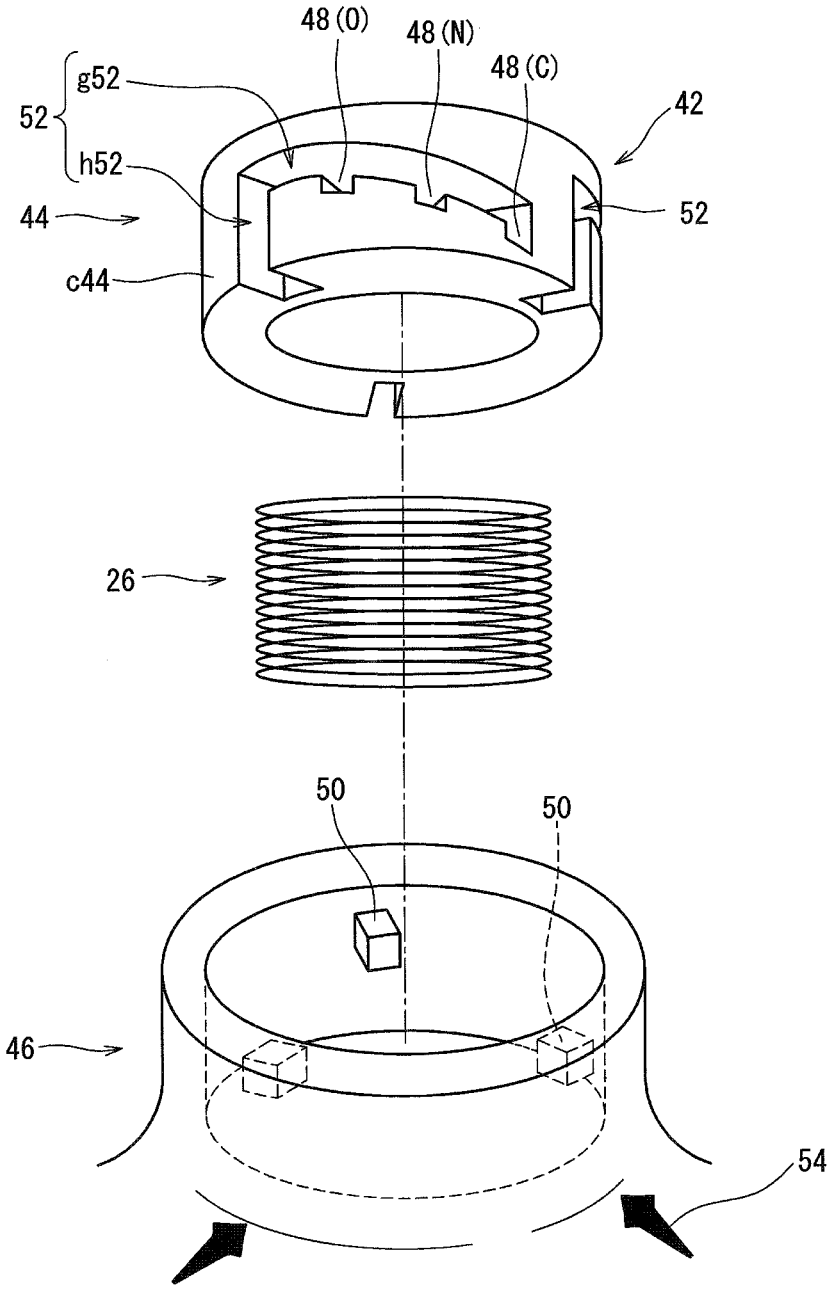
FIG. 12 is a perspective view showing another example of a face angle adjusting member before being assembled.

FIG. 12 shows a face angle adjusting mechanism 42 including a grounding member 44 in which a part to be locked 48 is formed, and a storing part 46 in which a locking projection 50 as the locking part is formed. The coil spring 26 as the elastic member is disposed between the grounding member 44 and the bottom face of the storing part 46.

A groove 52 with which the locking projection 50 can be engaged is formed in an outer peripheral surface of a cylindrical part c44 of the grounding member 44. The groove 52 includes an attaching/detaching groove h52 and a guiding groove g52 continuous to the attaching/detaching groove h52. The part to be locked 48 is formed in the guiding groove g52. The attaching/detaching groove h52 extends in an axial direction from an opening side end part of the cylindrical part c44. One end of the attaching/detaching groove h52 is outwardly opened from the opening side end part of the cylindrical part c44. The other end of the attaching/detaching groove h52 does not lead to a disc part side end part (not shown) of the cylindrical part c44. The guiding groove g52 is continuous to the other end of the attaching/detaching groove h52, and extends in a direction slightly inclined to the axial direction from the circumferential direction of the cylindrical part c44. That is, the direction in which the guiding groove g52 extends includes a circumferential component. The inclination of the axial direction may be inclination (FIG. 12) turning to the opening side end part of the cylindrical part c44, and may be inclination turning to the disc part side end part (not shown) of the cylindrical part c44.

The guiding groove g52 is sectioned into three at intervals of 120 degrees along the circumferential direction. The circumferential lengths of the sections of the guiding groove g52 are the same. The attaching/detaching groove h52 is formed in the end part of each of the sections of the guiding groove g52. The sections of the guiding groove g52 are formed at the same position in the axial direction. The inclination angles of the sections of the guiding groove g52 to the axial direction from the circumferential direction are the same. The combinations of the attaching/detaching grooves h52 and the guiding grooves g52 in the sections have the same shape.

In the embodiment, the grooves 52 of the three sections are independent without being communicated with each other. However, the constitution is not limited. The attaching/detaching groove h52 of one section may be communicated with the guiding groove g52 of the adjacent section thereby to communicate all the sections of the grooves 52 with each other.

The part to be locked 48 is a portion notched to the opening side end part in the axial direction from the guiding groove g52. In the embodiment, the part to be locked 48 has an approximately complementary shape to the locking projection 50. The locking projection 50 is locked to the part to be locked 48 toward the opening side of the grounding member 44 in the axial direction, and can be locked also in the circumferential direction. The three parts to be locked 48 are formed at regular intervals in the circumferential direction in the guiding groove g52 in each of the sections described above. In the embodiment, the parts to be locked 48 are formed at intervals of 30 degrees. The circumferential distance between the attaching/detaching groove h52 and the adjacent part to be locked 48 is also 30 degrees.

All the parts to be locked 48 have the same shape. That is, the circumferential width and the axial depth size of all the parts to be locked 48 are the same. Therefore, the axial depth end positions of the three parts to be locked 48 correspond to the inclination of the guiding groove g52. The part to be locked 48 positioned on the most opening side of the grounding member 44, of the three parts to be locked 48 is the same part to be locked 48 of C (closed) described above. The part to be locked 48 positioned on the most disc part (not shown) side is the same part to be locked 48 of O (opened) described above. The part to be locked 48 of N (neutral) is positioned between the part to be locked 48 of C and the part to be locked 48 of O in the axial direction. The difference in size at the axial position between the part to be locked 48 of C and the part to be locked 48 of N is the same as the difference in size at the axial position between the part to be locked 48 of N and the part to be locked 48 of O.

The locking projection 50 is provided so as to be inwardly protruded in the radial direction on the inner peripheral surface of the storing part 46. In the embodiment, the three locking projections 50 are provided at intervals of 120 degrees. However, the number of the locking projections is not limited to 3. The number of the locking projections can be decreased or increased corresponding to the number of the sections of the guiding groove g52 of the grounding member 44 described above. Although the locking projection 50 has a rectangular columnar shape in the embodiment, the shape of the locking projection 50 is not limited to the rectangular columnar shape. The locking projection 50 may have a columnar shape or the like. The locking projection 50 has an approximately complementary cross-sectional shape to the part to be locked 48 and the groove 52.

As shown in FIG. 12, arrows 54 are applied to positions corresponding to the three locking projections 50 around the storing part 46. The arrows 54 are applied at intervals of 120 degrees around the storing part 46. The arrows 54 inwardly turn in the radial direction.

Meanwhile, although not illustrated, the above-described marks of O, N, and C are applied so as to correspond to the circumferential positions of the three parts to be locked 48 in each of the three sections on the grounding surface of the disc part of the grounding member 44. Dot marks (not shown) are applied to positions corresponding to the positions of the three attaching/detaching grooves h52. Furthermore, an locking groove (not shown) with which the rotary tool can be engaged is formed in the central part of the grounding surface of the disc part. The grounding member 44 is rotated in a state where the grounding member 44 is attached to the storing part 46 to make any of the marks of O, N, C and dot correspond to the arrows 54, and thereby the locking projections 50 can be positioned to the three parts to be locked 48 of O, N, and C, and the attaching/detaching grooves h52.

The locking projections 50 are positioned to the three parts to be locked 48 of O, N, and C, and thereby the protruding amount of the grounding member 44 from the storing part 46 can be adjusted as in FIGS. 11A, 11B and 11C. Thereby, the posture of the head 4 is changed. The face angle can be adjusted in a state where a predetermined lie angle is maintained.

Although the face angle is adjusted at three stages of C (closed), N (neutral), and O (opened) in the embodiment described above, the constitution is not limited. For example, the number of the set ranges may be increased to five stages of opened−2, opened−1, neutral, closed+1, and closed+2, or the like. A plurality of grounding members having different protrusion heights may be prepared. For example, a first grounding member which can be adjusted at three stages of opened−2, opened−1, and neutral, and a second grounding member which can be adjusted at different three stages of neutral, closed+1, and closed+2 may be prepared.

The description hereinabove is merely for an illustrative example, and various modifications can be made in the scope not to depart from the principles of the present invention.

What is claimed is:

1. A golf club comprising:

a shaft;

a head comprising a sole; and a face angle adjusting mechanism provided on the sole, wherein the face angle adjusting mechanism comprises: a grounding member which can be protruded from the sole; a storing part storing the grounding member; and an elastic member pressing the grounding member so that the grounding member is protruded from the storing part;

the grounding member is set so that a protruding amount of the grounding member from the sole is varied depending on its position of rotation angle about its axis in a state where the grounding member is stored in the storing part; and the protruding amount of the grounding member is changed thereby to change a face angle, by changing a position of rotation angle of the grounding member against a pressing force of the elastic member.

2. The golf club according to claim 1, wherein one of the grounding member and the storing part comprises a plurality of parts to be locked;

the other of the grounding member and the storing part comprises a locking part which can be engaged with each of the parts to be locked;

each of the plurality of parts to be locked corresponds to each of a plurality of different protruding positions of the grounding member;

the locking part and the part to be locked are locked by the pressing of the elastic member, thereby to position the grounding member at a protruding position corresponding to the part to be locked.

3. The golf club according to claim 2, wherein the grounding member comprises a columnar outer peripheral surface;

the storing part comprises a columnar inner peripheral surface;

the part to be locked comprises a part of a hollow formed in one of the outer peripheral surface of the grounding member and the inner peripheral surface of the storing part;

the locking part comprises a locking projection formed on the other of the outer peripheral surface of the grounding member and the inner peripheral surface of the storing part; and the locking projection can be guided and locked to the hollow.

4. The golf club according to claim 3, wherein the hollow comprises the part to be locked and a guiding part;

the guiding part comprises one of a bump and a groove extending in a direction including a circumferential component;

the part to be locked comprises a notched part formed toward an axial direction from the guiding part;

the guiding part can guide circumferential movement of the locking projection in a state where the locking projection is pressed by the elastic member;

the grounding member is pressed by the elastic member thereby to elastically lock the locking projection in the axial direction to the part to be locked so as to bring about a state where the grounding member cannot be protruded in the axial direction, and cannot be rotated about its axis; and the grounding member is pressed against a pressing force of the elastic member thereby to separate the locking projection from the part to be locked so as to bring about a state where the grounding member can be rotated about its axis.

5. The golf club according to claim 4, wherein the guiding part is inclined to the axial direction from a circumferential direction;

the plurality of parts to be locked are formed; and axial depth sizes of all the parts to be locked from the guiding part are the same.

6. The golf club according to claim 4, wherein the guiding part extends in a circumferential direction without being inclined in the axial direction;

the plurality of parts to be locked are formed; and axial depth sizes of all the parts to be locked from the guiding part are different from each other.

7. The golf club according to claim 1, wherein the elastic member is a spring member interposed between a bottom part of the storing part and the grounding member.

8. The golf club according to claim 1, wherein the grounding member comprises a disc part and a cylindrical part formed around the disc part; and an outer surface of the disc part has a spherical shape outwardly protruded from the storing part.

9. The golf club according to claim 8, wherein the storing part comprises a columnar internal space;

the grounding member is coaxially stored in the storing part; and the disc part of the grounding member can be protruded from an opening end of the storing part.

10. The golf club according to claim 1, wherein a first surface and a second surface recessed to a crown side from the first surface are formed on a surface of the sole; and the storing part is provided on the second surface.

11. The golf club according to claim 10, wherein a height from the second surface to an upper end of the storing part is the same as a height from the second surface to the first surface.

12. The golf club according to claim 1, wherein the face angle is more largely closed as the protruding amount of the grounding member from the sole is larger.

13. The golf club according to claim 1, wherein an adjustable range of the face angle is set to 2 degrees or greater and 10 degrees or less.

* * * * *